US009156148B2

(12) United States Patent
King et al.

(10) Patent No.: US 9,156,148 B2
(45) Date of Patent: Oct. 13, 2015

(54) PRESET ELECTRONIC TORQUE TOOL

(71) Applicant: Snap-on Incorporated, Kenosha, WI (US)

(72) Inventors: Jerry A. King, Hacienda Hts., CA (US); Chris M. Lawton, Costa Mesa, CA (US); Nathan J. Lee, Escondido, CA (US)

(73) Assignee: Snap-on Incorporated, Kenosha, WI (US)

( * ) Notice: Subject to any disclaimer, the term of this patent is extended or adjusted under 35 U.S.C. 154(b) by 282 days.

(21) Appl. No.: 13/891,576

(22) Filed: May 10, 2013

(65) Prior Publication Data

US 2014/0331831 A1 Nov. 13, 2014

(51) Int. Cl.
*B25B 23/142* (2006.01)

(52) U.S. Cl.
CPC ..... *B25B 23/1425* (2013.01)

(58) Field of Classification Search
CPC ..... B25B 23/1425
See application file for complete search history.

(56) References Cited

U.S. PATENT DOCUMENTS

| | | | | |
|---|---|---|---|---|
| 5,303,601 | A | 4/1994 | Schöonberger et al. | |
| 7,182,147 | B2 * | 2/2007 | Cutler et al. | 173/1 |
| 7,562,589 | B2 * | 7/2009 | Anjanappa et al. | 73/862.23 |
| 7,954,557 | B2 * | 6/2011 | Cutler et al. | 173/1 |
| 8,065,806 | B2 * | 11/2011 | Rainone et al. | 33/1 PT |
| 8,171,828 | B2 | 5/2012 | Duvan | |
| 8,234,936 | B2 * | 8/2012 | Nakata et al. | 73/862.26 |
| 8,485,075 | B1 * | 7/2013 | Gauthier et al. | 81/479 |
| 8,714,057 | B2 * | 5/2014 | Anjanappa et al. | 81/479 |
| 8,886,492 | B2 * | 11/2014 | Wener | 702/151 |
| 9,000,936 | B2 * | 4/2015 | Hsieh | 340/665 |
| 2005/0173142 | A1 * | 8/2005 | Cutler et al. | 173/181 |
| 2007/0119269 | A1 | 5/2007 | Anjanappa et al. | |
| 2007/0272423 | A1 * | 11/2007 | Cutler et al. | 173/1 |
| 2009/0165608 | A1 | 7/2009 | Li | |
| 2009/0260491 | A1 * | 10/2009 | Rainone et al. | 81/479 |
| 2011/0132157 | A1 * | 6/2011 | Duvan et al. | 81/479 |

(Continued)

FOREIGN PATENT DOCUMENTS

| | | | |
|---|---|---|---|
| CN | 1775480 | A | 5/2006 |
| CN | 102179791 | A | 9/2011 |

(Continued)

OTHER PUBLICATIONS

Combined Search and Examination Report for GB 1407719.2, dated Aug. 22, 2014.

(Continued)

*Primary Examiner* — David B Thomas
(74) *Attorney, Agent, or Firm* — Seyfarth Shaw LLP

(57) ABSTRACT

An electronic torque wrench or other tool, and a method and a computer program for using the same, are disclosed. The disclosed systems allow a user to operate the tool in either a manual mode or automatic mode. In the manual mode, torque or angle targets are input into the wrench before the torqueing operation, and in the automatic mode, preset torque or angle targets are selected by the user. A user can also lock the tool so only a specific torqueing operation can be used without unlocking the tool. The torque and angle values can be input simultaneously such that a work piece can be torqued to a predetermined torque and angle without separate operations. An indicator can also be implemented that indicates the progress of the torqueing operation.

15 Claims, 8 Drawing Sheets

(56) References Cited

U.S. PATENT DOCUMENTS

| | | | | |
|---|---|---|---|---|
| 2011/0162493 | A1 | 7/2011 | Anjanappa et al. | |
| 2011/0278037 | A1* | 11/2011 | Cutler et al. | 173/176 |
| 2012/0048072 | A1* | 3/2012 | Rainone et al. | 81/467 |
| 2012/0132043 | A1* | 5/2012 | Chen et al. | 81/479 |
| 2012/0234569 | A1* | 9/2012 | Lawton et al. | 173/181 |
| 2012/0312132 | A1* | 12/2012 | Li et al. | 81/479 |
| 2013/0047799 | A1* | 2/2013 | Gareis | 81/467 |
| 2013/0249700 | A1 | 9/2013 | Hsieh | |

FOREIGN PATENT DOCUMENTS

| | | | |
|---|---|---|---|
| DE | 202012102497 | U1 | 9/2012 |
| JP | 2011088265 | | 5/2011 |
| TW | I367806 | | 7/2012 |
| WO | WO 2013/043986 | A1 | 3/2013 |

OTHER PUBLICATIONS

Taiwan Search Report; dated Jul. 8, 2015; 7 pages.

UK Government Patent Examination Report dated Jul. 30, 2015; 4 pages.

China Patent Office, first Office Action, dated Jul. 29, 2015 with English Translation; 17 pgs.

* cited by examiner

PRESET ELECTRONIC TORQUE TOOL

TECHNICAL FIELD OF THE INVENTION

The present application relates to tools for applying torque to a work piece. More particularly, the present application relates to electronic torque wrenches with preset torque and angular application values and indicators to provide indication to a user of approaching the torque or angular values.

BACKGROUND OF THE INVENTION

Electronic torque wrenches are commonly used to apply a desired amount of torque to a work piece, such as a bolt or nut, to ensure proper tightening of the work piece. For example, a mechanic may need to apply 100 ft-lb of torque to separate head bolts of a car. Typically, the mechanic manually sets the torque wrench to the 100 ft-lb setting, which alerts the mechanic when the 100 ft-lb setting is reached for the head bolt that is being worked on. The wrench could also be manually set to alert the user when the work piece is rotated a predetermined angle, for example, 270 degrees. However, often the mechanic miscounts the number of head bolts that were properly tightened or applies the torque wrench to head bolts that have already been tightened, thus leaving some of the head bolts not properly tightened. Moreover, because there is no indication to the mechanic that the desired amount of torque or angular rotation is approaching, the mechanic relies exclusively on the indicator to provide a single indication once 100% of the desired torque is reached, often resulting in over-torque conditions since the mechanic did not realize that the 100% mark was approaching.

Most electronic torque wrenches only include a manual setting, where a user must select a torque or angle setting for each group of work pieces, rather than choosing a preset torque or angle preset into a memory of the torque wrench. The user must therefore input the required torque and/or angular rotation for a desired torqueing operation each time the set of work pieces are acted upon by the tool, thereby introducing the possibility of error through incorrect torque or angle settings input by the user. Some torque wrenches include preset torque and angle targets, but then lack a manual mode and operate only in the preset automatic mode.

Some current torque wrenches also alert the user when the targeted torque is reached within a predetermined tolerance, but such tolerance is not adjustable by the user. More sensitive torqueing operations are therefore subject to the same torqueing tolerances as less sensitive operations. Also, some torque wrenches allow a user to switch between torque measurement and angular measurement modes, to ensure that both the proper amount of torque and amount of angular rotation is applied by the wrench, but these wrenches must be disengaged from the work piece when changing modes, often resulting in inaccurate angular measurements.

There therefore exists a need for a torque application tool that is capable of providing indications to the user when certain levels of the desired amount of torque or angular rotation are reached, thus alerting the user that the desired amount of torque or angular rotation are approaching to lessen the chance of over-torqueing. There also exists a need for a torque application tool that is capable of providing an indication to the user when both the desired torque amount and the desired angular rotation are simultaneously applied to a work piece. There exists a further need for a torque application tool capable of providing an indication to the user when the desired amount of torque is first reached, and then the desired amount of angular rotation is applied to the work piece without removing the tool from the work piece to change from torque measurement to angular measurement modes.

SUMMARY OF THE INVENTION

The present application discloses an electronic torque tool adapted to allow a user to operate the tool in either a manual mode, where torque and/or angular targets are input into the tool by the user before the torqueing operation, or an automatic mode, where preset torque and/or angular rotational targets, and/or desired torque application counts are selected. The torque and angular rotational values can be measured simultaneously such that a work piece can be torqued to a predetermined torque and angular rotation without removal of the tool from the work piece, or sequentially so that the predetermined amount of torque is applied first and then the predetermined amount of angular rotation is applied to the work piece. The tool can also be locked so only a specific torqueing operation can be used without unlocking the tool. In another embodiment, an indication means, such as a series of light-emitting diodes (LEDs), provides indication to the user when the torqueing operation has reached a predetermined percentage of the target, for example, 20%, 40%, 80%, 100%, 105%, etc., to alert the user when the desired torque application is being reached, thus avoiding over-torqueing of the work piece.

In particular, the present application discloses a tool adapted to apply a torque to a work piece, including a head adapted to apply the torque to the work piece, a sensor operably coupled to the head and adapted to sense the torque applied to the work piece by the head, an interface adapted to receive a target value, the target value being a desired amount of the torque to be applied to the work piece, and an indicator adapted to provide a first indication to a user when the head applies a first predetermined percentage of the target value to the work piece and a second indication to the user when the head applies a second predetermined percentage of the target value.

Also disclosed is a torque wrench having a head adapted to apply a torque to a work piece, including a sensor operably coupled to the head and adapted to sense the torque applied to the work piece by the head, an interface adapted to receive a target value from a user, the target value being at least one of a desired amount of the torque and an amount of angular rotation to be applied to the work piece, and a first LED adapted to provide a first indication to the user when the head applies a first predetermined percentage of the target value to the work piece, a second LED adapted to provide a second indication to the user when the head applies a second predetermined percentage of the target value, and a third LED adapted to provide a third indication to the user when the head applies a third predetermined percentage of the target value, wherein the first predetermined percentage is about 80%, the second predetermined percentage is about 100% and the third predetermined percentage is about 105%.

Further disclosed is a tool adapted to apply a torque to a work piece, including a head adapted to apply the torque and an angular rotation to the work piece, a sensor operably coupled to the head and adapted to sense an amount of the torque applied to the work piece and an amount of the angular rotation applied by the head to the work piece, an interface adapted to receive a desired amount of the torque and a desired amount of angular rotation to the work piece, and an indicator adapted to provide an indication to a user when the desired amount of torque and the desired amount of angular rotation have been applied to the work piece by the head.

In addition, a tool is disclosed adapted to apply a torque to a work piece, including a head adapted to apply the torque and an angular rotation to the work piece, a sensor operably coupled to the head and adapted to sense an amount of the torque and an amount of angular rotation applied to the work piece by the head, an interface adapted to receive a target value, the target value being a desired amount of the torque to first be applied to the work piece, and a desired amount of angular rotation to be applied to the work piece after the desired amount of the torque has been applied to the work piece, and an indicator adapted to provide a first indication to a user when the desired amount of the torque has been applied to the work piece and, after the desired amount of the torque has been applied to the work piece, a second indication to the user when the desired amount of angular rotation has been applied to the work piece.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1:
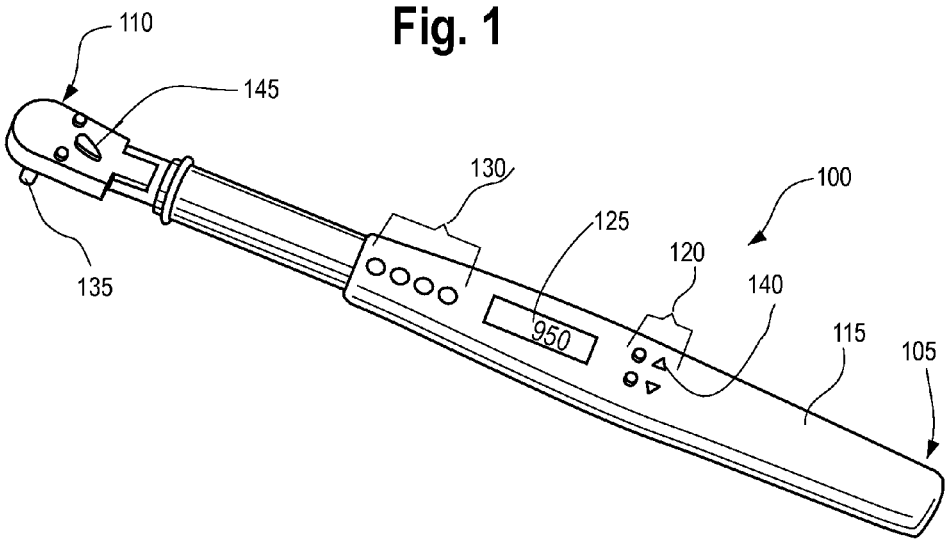
FIG. 1 is a perspective view of an electronic torque tool in accordance with embodiment(s) of the present application.

It should be understood that the comments included in the notes as well as the materials, dimensions and tolerances discussed therein are simply proposals such that one skilled in the art would be able to modify the proposals within the scope of the present application.

DETAILED DESCRIPTION OF THE EMBODIMENTS

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated.

The present application discloses an electronic torque wrench, a method, and a computer-readable medium storing a computer program, that allows a user to operate the wrench in either a manual mode, where torque or angle targets are input into the wrench before the torqueing operation, or an automatic mode, where preset torque or angle targets are selected. The torque and angle values can be input simultaneously such that a work piece can be torqued to a predetermined torque and angle without separate operations. A user can also lock the tool so only a specific torqueing operation can be used without unlocking the tool. An indicator, such as a series of light-emitting diodes (LEDs) can visually indicate to the user when the torqueing operation has reached a predetermined percentage of the target, for example, 20%, 40%, 80%, etc.

As shown in FIG. 1, a tool 100 is disclosed having a handle 105 and a head 110. The handle 105 can include a grip 115 for holding the handle 105, an interface 120 for inputting instructions such as torque or angle targets, and a display 125 for displaying data relating to the tool 100. An indicator 130 can also be included to visually indicate to the user when, for example, a predetermined amount of torque is applied to the work piece. The head 110 of the tool 100 can include a sensor 135 that senses the torque applied or angle of rotation of a work piece. The tool 100 can also include a button 140 located on the interface 120 and a reversing lever 145 for reversing a drive direction of the tool.

The grip 115 can be any structure capable of improving the user's grasp of the tool. For example, the grip 115 can be a knurled handle for cut grooves and a built-in calibration mark.

The interface 120 allows the user to input information or commands into the control 150. By way of example, the interface 120 can include a keyboard, mouse, touch screen, audio recorder, audio transmitter, member pad, or any other device that allows for the entry of information from a user. As shown in FIG. 1, in an embodiment, the interface 120 can include buttons 140, e.g., up/down control buttons and an "enter" key.

In an embodiment, the display 125 can display various information for the user to view and interpret, for example, text or graphics, or information entered into the interface 120. By way of example, the display 125 can include a liquid crystal display (LCD), organic light emitting diode (OLED) display, plasma screen, or any other kind of black and white or color display that will allow the user to view and interpret information. In an embodiment, the display 125 is a backlit and bitmapped LCD display.

The indicator 130 can be any structure that visually, audibly, or through tactile means, indicates to the user when a predetermined amount of progress has been made toward the torque or angle target. For example, the indicator 130 can be a series of LED lights, differently colored, that illuminate when the torqueing or angle operation reaches a predetermined percentage of completion. The LED lights can be colored green, yellow, and red, for example, and in any number. For example, the LED lights can include three yellow LEDs, one green LED, and one red LED, where the first yellow light illuminates when the torqueing operation reaches about 40%, the second yellow LED illuminates when the torqueing operation reaches about 60%, the third yellow LED illuminates when the torqueing operation reaches about 80%, the green LED illuminates when the torqueing operation reaches 100%, and the red LED illuminates when the torqueing operation reaches 105% or the upper limit. Alternatively, the indicator 130 can be a vibration mechanism that vibrates when these percentages are reached, or can be an audio speaker that audibly communicates when the percentages are reached. Progress toward the torque or angle target can also be shown on the display 125. Any other means of indicating a progress toward the target or angle target can be implemented without departing from the spirit and scope of the present application. A backlight on the display 125 can also illuminate as the torque and/or angle cycle is started, e.g., illuminating more as the application of torque reaches the upper limit.

Figure 2:
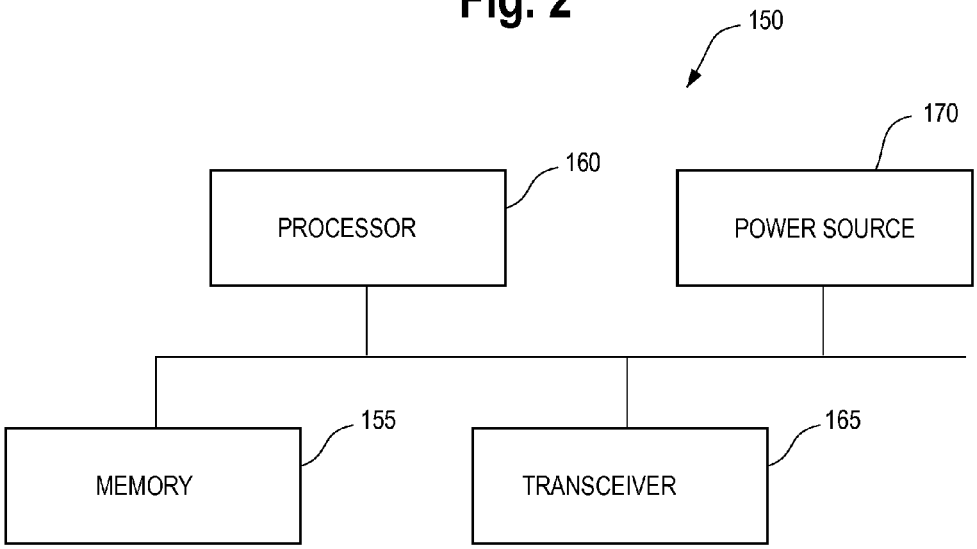
FIG. 2 is a schematic diagram of a control in accordance with an embodiment of the present application.

FIG. 2 is a schematic diagram of a control 150 in accordance with embodiment(s) of the present application. In some embodiments, the control 150 includes a memory 155 for storing data and/or computer programs, a processor 160 for controlling operations of the control 150, and a transceiver 165 for transmitting data relating to the tool 100 to external sources. The control 150 can also have a power source 170, for example a battery, for powering operations of the control 150 and the tool 100 in general. The above components of the control 150 can be coupled together, directly or indirectly, by any known means. Further, the control 150 and other electrical components of the tool 100 can be substantially enclosed by the handle 105 and head 110 to make the tool 100 more compact and reduce the possibility of damaging the electrical components of the tool, including the control 150.

In an embodiment, the memory 155 can store any data or computer programs for use in the tool 100. For example, the memory 155 can store preset torque and angle target values for use in the automatic setting, or can include temporary torque and angle target values for use in the manual setting. The memory 155 can also store an operating system for the control 150 or any other software or data that may be necessary for the tool 100 to function. Without limitation, the memory 155 can include any non-transitory computer-readable recording medium, such as a hard drive, DVD, CD, flash drive, volatile or non-volatile memory, RAM, or any other type of data storage.

The processor 160 facilitates communication between the various components of the tool 100 and controls operation of the electrical components of the tool 100. The processor 160 can be any type of processor or processors, for example, a desktop or mobile processor, embedded processor, a microprocessor, a single-core or a multi-core processor.

The transceiver 165 can be any device capable of transmitting data from the tool 100 or capable of receiving data within the tool 100 from an external data source. By way of example, the transceiver 165 can be any type of radio transmission antenna, cellular antenna, hardwired transceiver, or any other type of wired or wireless transceiver capable of communicating with an external device. For example, the transceiver 165 can be a USB port capable of interfacing with a USB flash drive or USB cord, and having a USB cover overlaying the USB port.

The power source 170 can be any source of electrical or mechanical power that can power the control 150. In an embodiment, the power source 170 is a battery. However, the power source 170 can be any component that provides power, including a battery, fuel cell, engine, solar power system, wind power system, hydroelectric power system, a power cord for attachment to an electrical socket, or any other means of providing power.

Figure 3:
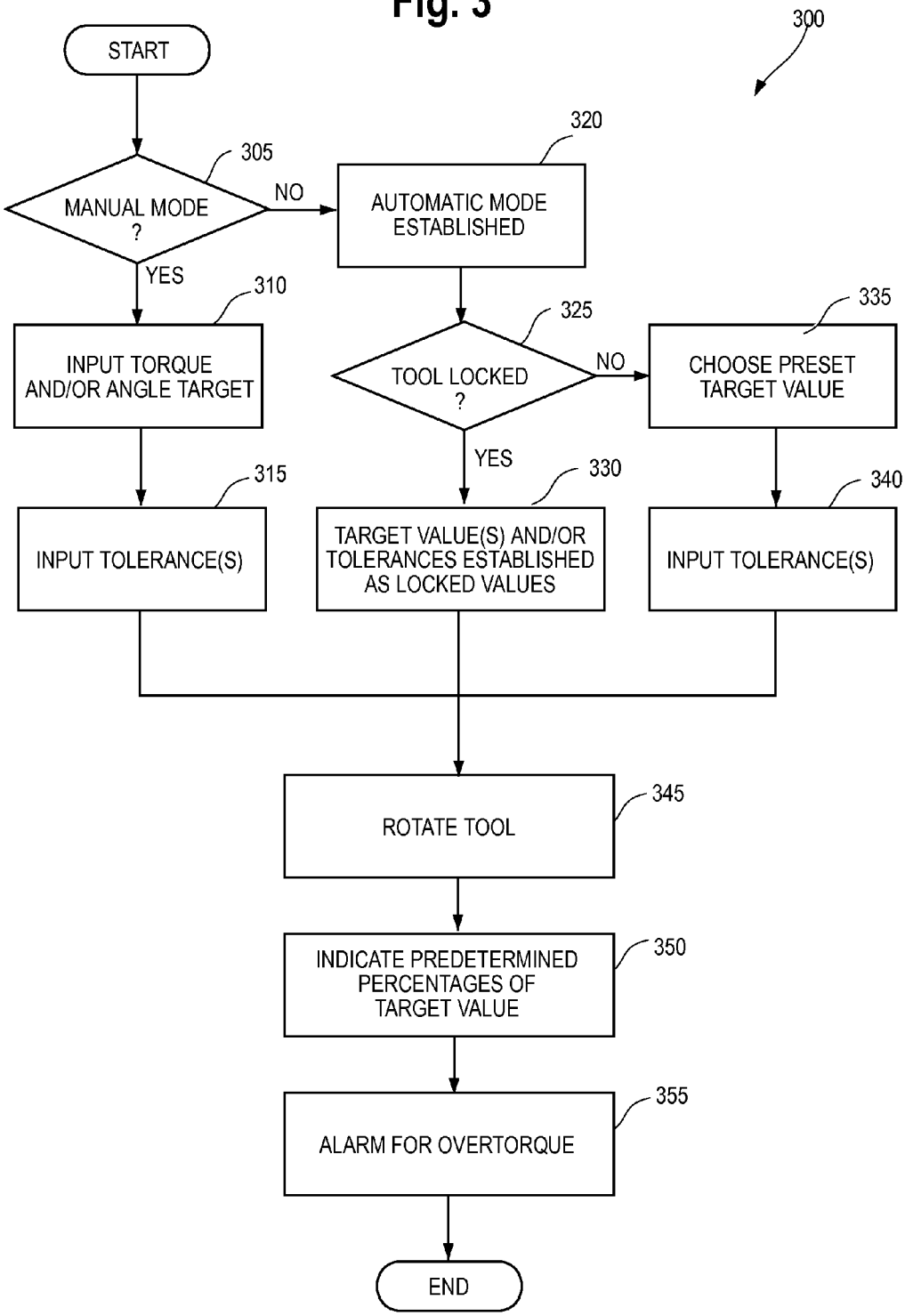
FIG. 3 is a flow chart illustrating a process in accordance with an embodiment of the present application.

FIG. 3 is a flowchart illustrating a process 300 according to an embodiment of the present application. As shown, the process 300 begins and proceeds to step 305, where it is determined if the tool 100 is in the manual mode or the automatic mode. The user can activate the manual or automatic modes by any known means, for example, by operating the interface 120 to choose the mode, or by pushing a button to choose a preset automatic mode, e.g., 100 ft-lb of torque. In the manual mode, for example, the user can input 100 ft-lb of torque as the torque input, and the tolerance can either be preset to a default level or selected and modified by the user. If the tool 100 is in the automatic mode 320, the user may select from the memory 155 any of several preset, stored settings to perform a torqueing operation on a work piece. These settings may be chosen by any known means, as discussed above. Following this step, the process proceeds to step 325 where it is determined whether the tool 100 is locked.

If the tool 100 is locked, a predetermined and locked set of target value(s) and/or tolerances are established as the operation parameters 330 for the torqueing operation. The locking feature allows a supervisor or other personnel to "lock" the tool 100 so that the tool 100 can be operated only for one or more preset torqueing operation. The locking feature does not allow the user to modify the torqueing operation, for example the target value(s) and/or tolerance(s), outside of the preset(s). For example, if a bolt requires a torqueing operation of 100 ft-lb, the locking feature can provide only the 100 ft-lb option for the user, and prevent the user from implementing another torqueing operation absent the tool 100 being unlocked.

In either the automatic or manual mode, a batch counter can be decremented each time the individual torque/angle value is reached for each work piece, and the decremented amount of work pieces remaining can be displayed on the display 125. The indicator 130 can also provide an indication to the user representing a difference between a number of work pieces that the desired amount of the torque and the desired amount of angular rotation have been applied and the total number of work pieces. In the automatic or manual mode, the amount of work pieces acted upon can also be counted and displayed on the display.

The user can also operate the tool 100 in the "job mode" where a sequence of torqueing operations are successively applied to multiple work pieces. The job mode is advantageous when a supervisor wants a user to implement a torqueing sequence in a particular order. For example, the job mode could implement a 100 ft-lb torque preset on the first bolt and 80 ft-lb torque preset on the subsequent nine bolts. Any other sequence of presets can be implemented without departing from the spirit and scope of the present application.

In step 310 or 335, for example, the user can input or select a target torque, and a target angle to be achieved simultaneously with the target torque. This configuration is advantageous to determine whether the user has properly torqued all the work pieces in the batch. For example, if the batch includes 20 bolts, a typical mistake is for the user to believe that all 20 bolts have been properly torqued, but where several of the bolts have been torqued more than once. Several of the bolts therefore remain loose. By allowing simultaneous torque and angle targets, the torque target can be reached to ensure proper tightening of the work piece, and the angle target can also be reached to ensure the fastener has actually been rotated the appropriate amount. The target angle can also ensure the work piece was tightened correctly to an expected angle measurement for that particular application. For example, hydraulic or fuel line fittings must be tightened to the correct torque but must also be rotated to a particular angle to ensure correct seating of the fastener and no stripping or cross-threading. Simultaneous torque/angle targets achieve this goal.

As yet another option, the user may enter the torque then angle mode where a torque and angle preset are achieved sequentially, rather than simultaneously, as discussed above. For example, the torque preset can be 100 ft-lb of torque and the angle preset can be 270 degrees. The user can rotate the work piece until the 100 ft-lb measurement is reached, and can subsequently continue rotation until the 270 degree angle is reached. This mode is advantageous because it does not require the user to remove the tool 100 from the work piece during operation, but allows two measurements to be achieved sequentially without tool 100 removal.

The process then proceeds to step 345, where the user rotates the tool 100 in accordance with the torqueing operation measured and stored by the manual or automatic mode. The user can rotate the tool 100 toward the torque target, and in the process of doing so, the indicator 130 can indicate the progress in step 350. For example, the indicator 130 can indicate when the tool 100 has reached 20%, 40%, and 100% of the torque target. These three percentage values can be visually or otherwise indicated by the indicator 130 in succession. For example, if the indicator 130 is a series of LEDs, the 20% value can be shown by a first yellow LED, the 40% value shown by a second yellow LED, and the 100% value shown by a green LED. Any number and color of LEDs can be implemented without departing from the spirit and scope of the present application.

In step 355, an alarm is activated if the user over-torques the work piece beyond the torqueing operation set forth in the manual or automatic mode. For example, the indicator 130 can illuminate a red LED or blink if the torqueing operation torques the work piece beyond the over tolerance input in step 325. Any other means of alerting the user can be implemented without departing from the spirit and scope of the present application.

Figure 4:
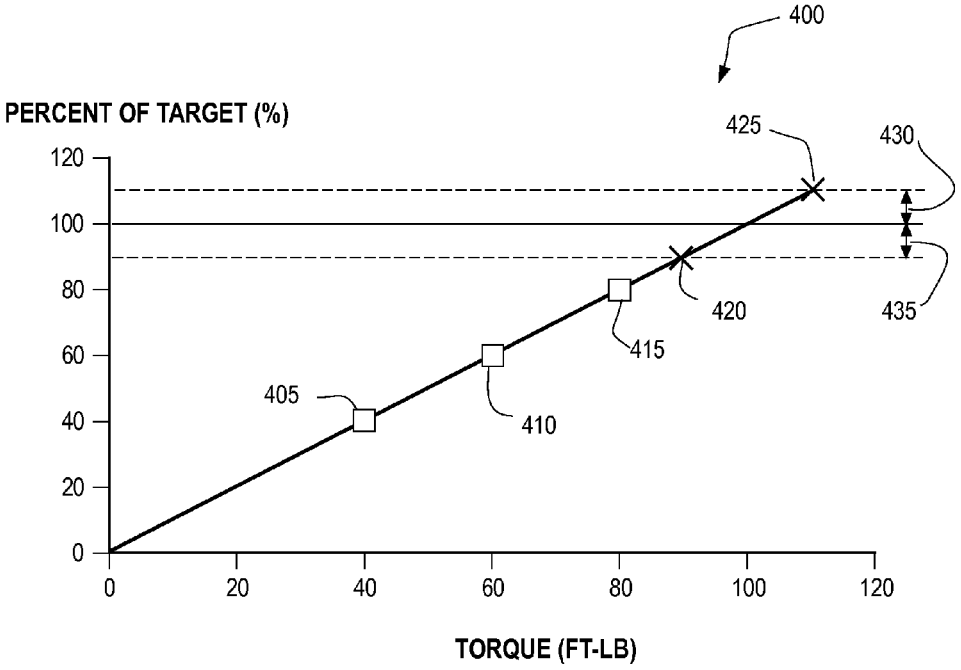
FIG. 4 is a graph illustrating indicator functionality in accordance with an embodiment of the present application.

FIG. 4 illustrates a graph 400 of a torqueing operation in accordance with an embodiment of the present application. As shown, the graph 400 includes a plot of values with the Y axis representing the Percent of Target (e.g., percent of the target torque value), and the X value representing the value relating to the target (e.g., torque if the target value is a specific torque value).

Various indicators are also included to show the different values at which the indicator 130 will alert the user, for example, by illuminating LEDs. For example, as shown, a first indicator 405 is shown at the 40% percent of target mark. It is here that a first LED, for example a yellow LED shown as a square, alerts the user that the tool 100 has reached 40% of the target torque value. A second 410 and third 415 indicator are also shown as squares, and can be illuminated as yellow LEDs in addition to the first indicator 405 in yellow. Fourth 420 and fifth 425 indicators can also be shown as x-marks on the graph 400. These indicators show when the user has torqued the work piece to the target value within the tolerances input by the user. For example, the fourth indicator 420 can be activated when the torqueing operation achieves the target torque within the lower tolerance 435 (i.e., 100% minus the lower tolerance 435). The fifth indicator 425 can be activated when the torqueing operation reaches the upper tolerance 430 of the target torque (i.e., 100% plus the upper tolerance 430). An alarm included within the indicator 130 can be activated if the user torques the work piece more than the upper tolerance 430.

As discussed above, any LED sequence may be implemented as the indicator. For example, the yellow LED(s) can turn off when the green or red LED(s) illuminate. The indicator 130 sequence can be different in manual mode versus automatic mode. For example, in the manual mode, default tolerances can be input that the user can later modify. For torque operations below a predetermined torque value, the default tolerance can be a larger percentage of the target torque as compared to when a larger target torque is input by the user. For example, for a 10 ft-lb torque, a default 10% tolerance can be implemented so the target torque (between 9-11 ft-lb) is a suitable range that can be achieved by the user. However, for a 100 ft-lb target torque, a 4% default tolerance can be implemented because this tolerance still provides for a sufficiently large torque range for the target torque (here, 96 ft-lb to 104 ft-lb).

Figure 5:
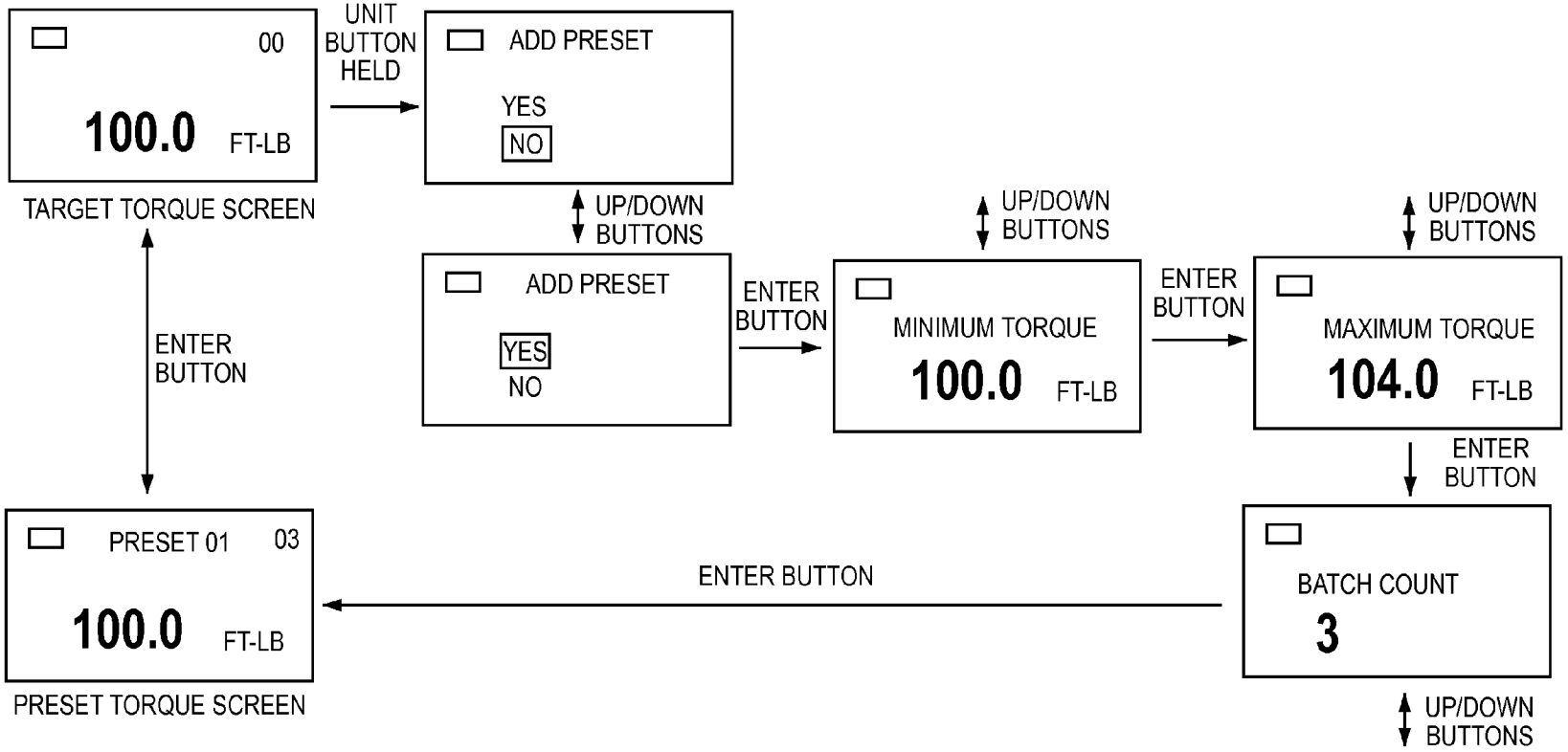
FIG. 5 is a diagram showing various screenshots for the preset target entry.

FIGS. 5-9 illustrate diagrams of various screenshots according to embodiments of the present application. For example, FIG. 5 illustrates a sequence of screenshots for when the preset targets are entered. As shown, the preset torque value can be dictated using up and down buttons and selected using an enter button. In FIG. 5, the torque preset is 100.0 ft-lb and the maximum torque is 104.0 ft-lb. A batch count can also be selected, and in FIG. 5 the batch is selected as three work pieces.

Figure 6:
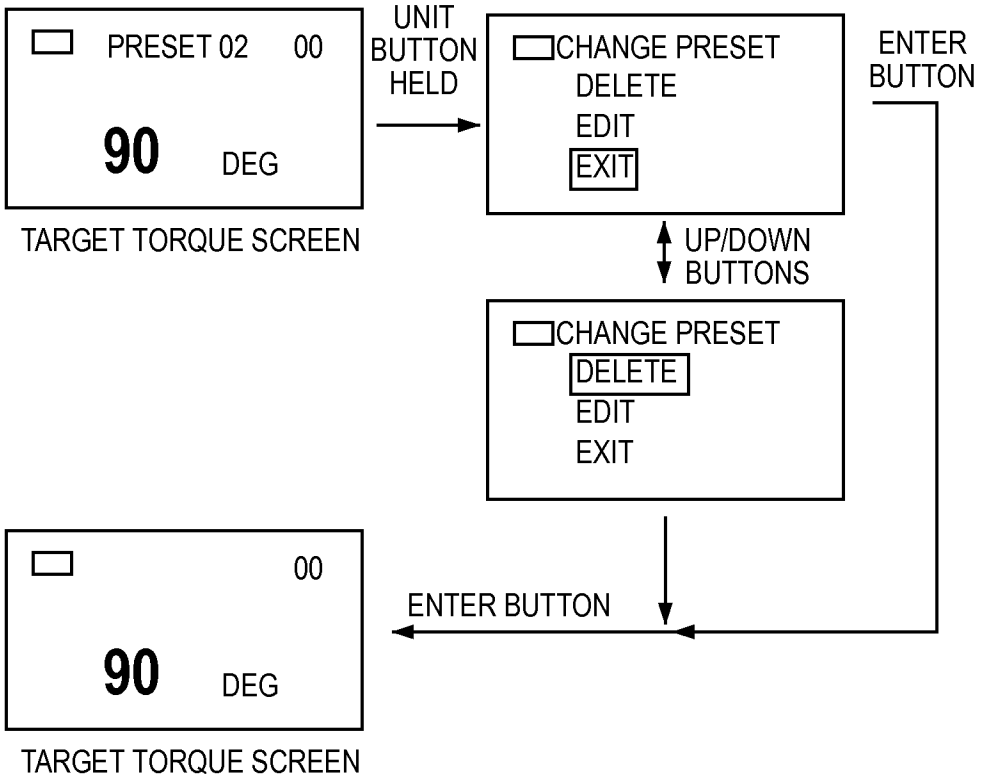
FIG. 6 is a diagram showing various screenshots for the preset delete command.

FIG. 6 illustrates a diagram showing various screenshots of a preset delete command. As shown, using up/down arrows and an enter button, a preset of 90 ft-lb can be deleted from the memory 155. Alternatively, the "EDIT" button can be used to change the 90 ft-lb target to a torque target better suited for the task at hand.

Figure 7:
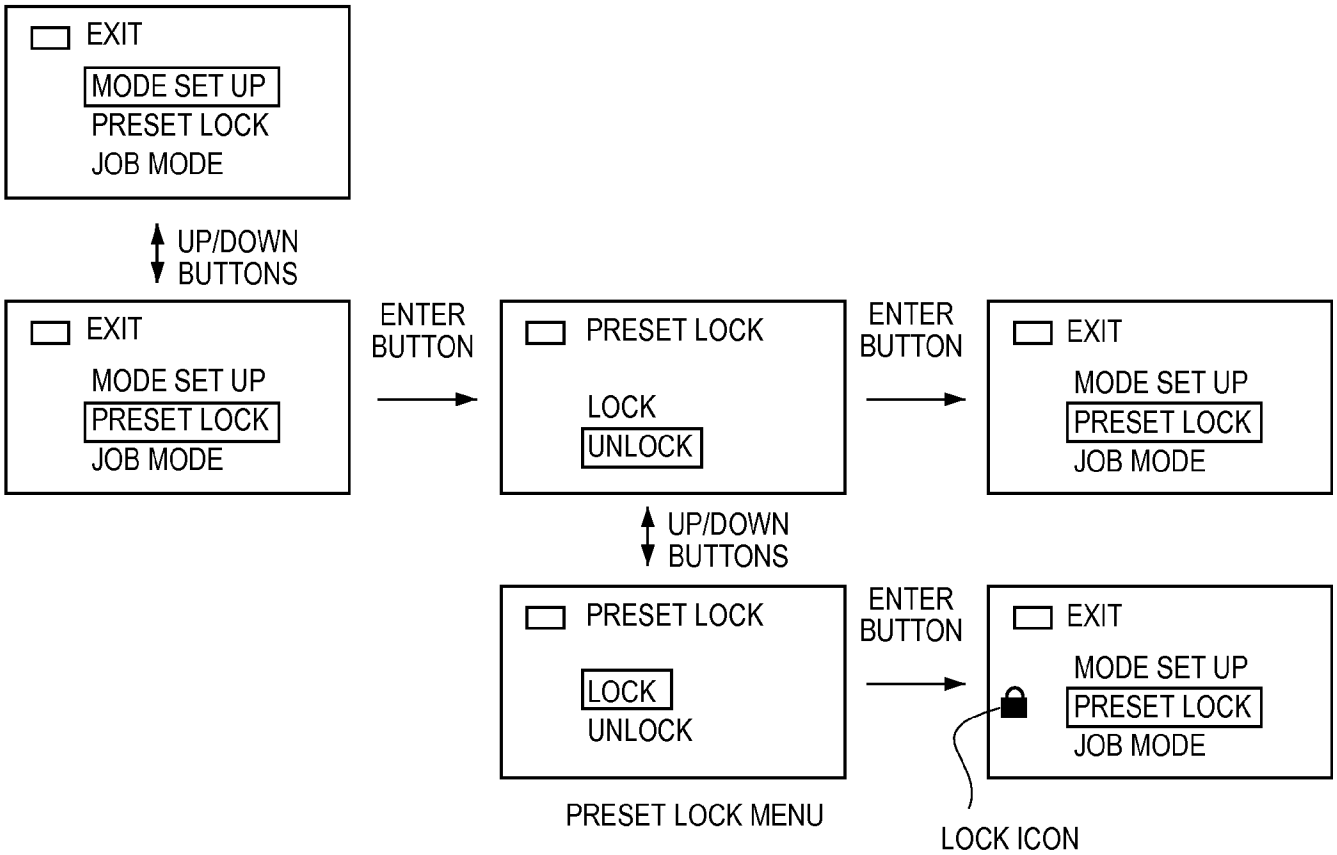
FIG. 7 is a diagram showing various screenshots for the wrench locking mode.

FIG. 7 illustrates a diagram showing various screenshots of a wrench locking command. As shown, the user can select a "MODE SETUP" entry and "PRESET LOCK" command using up/down arrows and an enter button. The locking command is reversed by a password entry or other secure means.

Figure 8:
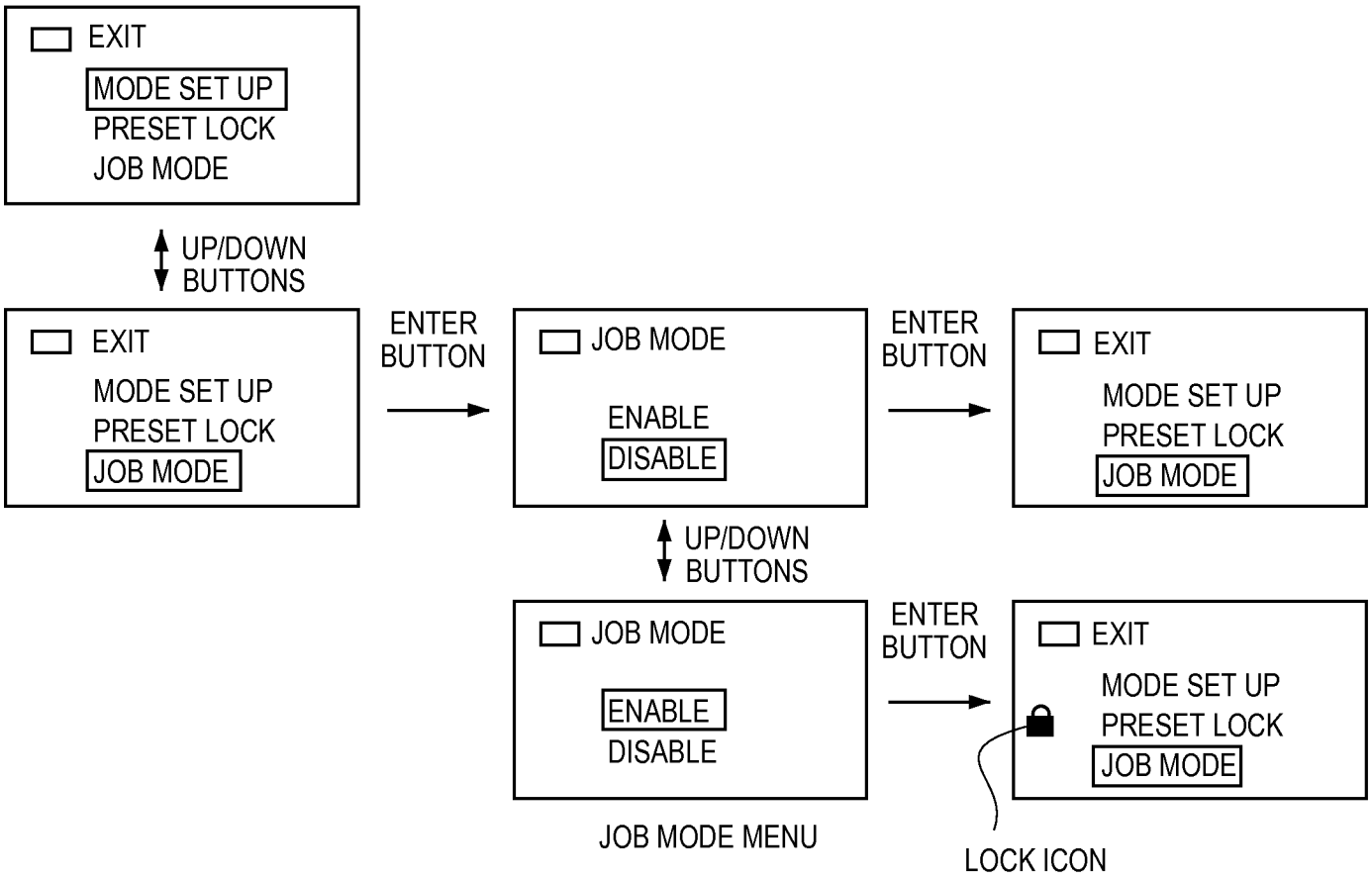
FIG. 8 is a diagram showing various screenshots for the job mode selection.

FIG. 8 illustrates a diagram showing various screenshots of a "JOB MODE" selection. As shown, the Job Mode can be selected and locked through up/down arrows in combination with an "enter" button.

Figure 9:
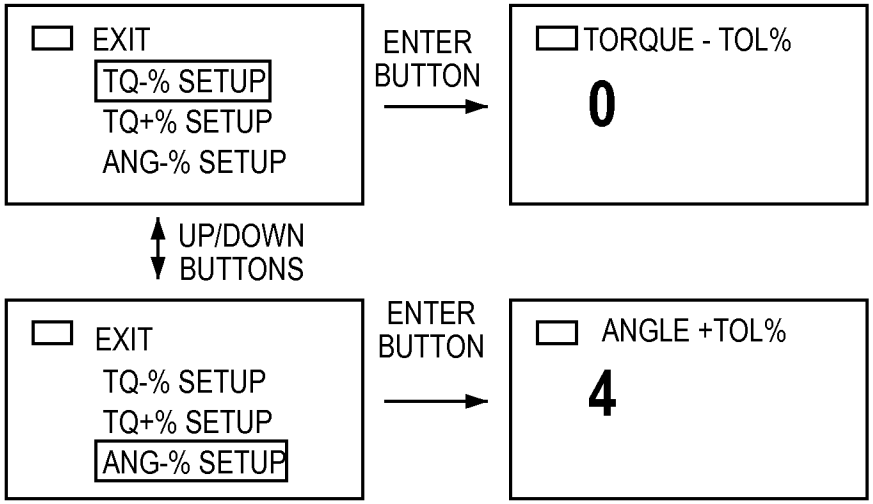
FIG. 9 is a diagram showing various screenshots for the tolerance entry.

FIG. 9 illustrates a diagram showing various screenshots of a tolerance entry command for the manual mode. As shown, the tolerance can be input as a percentage of the overall torque or angle target. Alternatively, the tolerance can be input as a torque or angle value rather than a percentage of the target value.

As discussed above, the tool 100 is an electronic torque wrench. However, the tool 100 can be any mechanism for imparting torque onto a work piece without departing from the spirit and scope of the present application. For example, and without limitation, the tool 100 can be a ratchet wrench, open wrench, monkey wrench, or any other tool capable of imparting torque to a work piece.

As used herein, the term "coupled" or "communicably coupled" can mean any physical, electrical, magnetic, or other connection, either direct or indirect, between two parties. The term "coupled" is not limited to a fixed direct coupling between two entities.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A tool adapted to apply a torque to a work piece, comprising:

a head adapted to transmit the torque to the work piece;

a sensor operably coupled to the head and adapted to sense an amount of the torque applied to the work piece;

an interface adapted to receive an amount of tolerance and a target value representing a desired amount of the torque to be applied to the work piece; and an indicator adapted to provide a first indication when the amount of torque applied to the work piece is a first predetermined percentage of the target value, minus the amount of tolerance, and a second indication when the amount of torque applied to the work piece is a second predetermined percentage of the target value, plus the amount of tolerance.

2. The tool as claimed in claim 1, wherein the indicator is further adapted to provide a third indication when the amount of torque applied to the work piece is a third predetermined percentage of the target value, plus or minus the amount of tolerance, a fourth indication when the amount of torque applied to the work piece is a fourth predetermined percentage of the target value, plus or minus the amount of tolerance, and a fifth indication when the amount of torque applied to the work piece is a fifth predetermined percentage of the target value, plus or minus the amount of tolerance.

3. The tool as claimed in claim 2, wherein the third predetermined percentage is about 40%, the fourth predetermined percentage is about 60%, and the fifth predetermined percentage is about 80%.

4. The tool as claimed in claim 2, wherein the indicator includes an LED assembly.

5. The tool as claimed in claim 4, wherein the LED assembly includes a green LED, first, second, and third yellow LEDs, and a red LED, wherein the first indication illuminates the green LED, the second indication illuminates the red LED, the third indication illuminates the first yellow LED, the fourth indication illuminates the second yellow LED, and the fifth indication illuminates the third yellow LED.

6. The tool as claimed in claim 5, wherein the yellow LEDs are not illuminated when the green LED is illuminated, and the green LED is not illuminated when the red LED is illuminated.

7. The tool as claimed in claim 1, wherein the first and second predetermined percentages and the target value are each preset and cannot be changed by a user of the tool.

8. The tool as claimed in claim 1, wherein the target value further includes a desired amount of angular rotation to be applied to the work piece.

9. A torque wrench having a head adapted to transmit a torque to a work piece, comprising:

a sensor operably coupled to the head and adapted to sense an amount of the torque and an amount of angular rotation applied to the work piece;

an interface adapted to receive a target value and an amount of tolerance, the target value being at least one of a desired amount of the torque and a desired amount of angular rotation to be applied to the work piece; and a first LED adapted to illuminate when one of the amounts of torque and angular rotation applied to the work piece is a first predetermined percentage of the target value, a second LED adapted to illuminate when one of the amounts of torque and angular rotation applied to the work piece is a second predetermined percentage of the target value, and a third LED adapted to illuminate when one of the amounts of torque and angular rotation applied to the work piece is a third predetermined percentage of the target value, wherein the first predetermined percentage is about 80%, the second predetermined percentage is about 100% minus the amount of tolerance, and the third predetermined percentage is about 100% plus the amount of tolerance.

10. A tool adapted to apply a torque and angular rotation to a work piece, comprising:

a head adapted to transmit the torque and the angular rotation to the work piece;

a sensor operably coupled to the head and adapted to sense an amount of the torque and an amount of angular rotation applied to the work piece;

an interface adapted to receive an amount of tolerance and a target value representing a desired amount of the torque to first be applied to the work piece, and a desired amount of angular rotation to be applied to the work piece after the desired amount of the torque has been applied to the work piece; and an indicator adapted to provide a first indication to a user when the amount of the torque applied to the work piece is a first predetermined percentage of the target value, minus the amount of tolerance, and a second indication when the amount of torque applied to the work piece is a second predetermined percentage of the target value, plus the amount of tolerance.

11. The tool as claimed in claim 10, wherein the interface is further adapted to receive information relating to a total number of work pieces that the desired amounts of the torque and angular rotation are to be applied to, wherein the indicator provides a third indication representing a difference between a number of work pieces that the desired amounts of the torque and angular rotation have been applied to and the total number of work pieces.

12. The tool as claimed in claim 11, further comprising a display adapted to visually provide the third indication.

13. The tool as claimed in claim 10, wherein the indicator is adapted to provide a third indication representing a number of work pieces that the desired amounts of the torque and the angular rotation have been applied to.

14. The tool as claimed in claim 13, further comprising a display adapted to visually provide the third indication.

15. The tool as claimed in claim 10, wherein the target value is preset and cannot be changed by a user of the tool.

* * * * *